US008104448B2

(12) United States Patent
Kuribara et al.

(10) Patent No.: US 8,104,448 B2
(45) Date of Patent: Jan. 31, 2012

(54) BOLT FASTENING STRUCTURE FOR INTERNAL COMBUSTION ENGINE, AND ENGINE INCORPORATING SAME

(75) Inventors: Hiroshi Kuribara, Saitama (JP); Mitsuyoshi Kamiya, Saitama (JP); Shingo Ueda, Saitama (JP); Sumiko Fukuzawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 367 days.

(21) Appl. No.: 12/380,528

(22) Filed: Feb. 27, 2009

(65) Prior Publication Data

US 2009/0241893 A1 Oct. 1, 2009

(30) Foreign Application Priority Data

Mar. 31, 2008 (JP) ..... 2008-094133

(51) Int. Cl.
*F02F 7/00* (2006.01)

(52) U.S. Cl. ..... 123/195 R; 123/195 A

(58) Field of Classification Search ..... 123/195 R, 123/195 H

See application file for complete search history.

(56) References Cited

U.S. PATENT DOCUMENTS

| | | | | |
|---|---|---|---|---|
| 3,977,303 | A * | 8/1976 | Baker | 91/493 |
| 6,971,362 | B2 * | 12/2005 | Gunji et al. | 123/195 R |
| 6,973,907 | B2 * | 12/2005 | Satou | 123/195 R |
| 7,011,068 | B2 * | 3/2006 | Yamagata et al. | 123/195 A |
| 7,086,371 | B2 * | 8/2006 | Sanada et al. | 123/195 R |
| 2002/0017266 | A1 * | 2/2002 | Tsutsumikoshi | 123/195 R |
| 2003/0098006 | A1 * | 5/2003 | Satou | 123/195 R |
| 2005/0076862 | A1 * | 4/2005 | Satou | 123/41.74 |
| 2005/0109306 | A1 * | 5/2005 | Takahashi et al. | 123/195 R |
| 2007/0119404 | A1 * | 5/2007 | Yuasa et al. | 123/195 R |

FOREIGN PATENT DOCUMENTS

| | | | |
|---|---|---|---|
| JP | 2002339931 | * | 5/2001 |
| JP | 2002-339931 | | 11/2002 |

* cited by examiner

*Primary Examiner* — Michael Cuff

*Assistant Examiner* — Long T Tran

(74) *Attorney, Agent, or Firm* — Carrier Blackman & Associates, P.C.; Joseph P. Carrier; William D. Blackman

(57) ABSTRACT

A bolt fastening structure for an internal combustion engine includes bolt fitting holes formed in a cylinder of the engine. An inner wall of a top portion of a crankcase includes boss portions having openings, as an extension to the corresponding bolt fitting holes, with internal threads formed therein. The crankcase further includes hollow recesses formed thereon between the boss portions and crankshaft rotational support portions. Fastening bolts, each having an external thread formed at a tip portion thereof, are extended through the bolt fitting holes, and engaged with the internal threads of the boss portion. The hollow recesses include portions of the openings of the boss portions having the internal threads opened therein.

17 Claims, 8 Drawing Sheets

BOLT FASTENING STRUCTURE FOR INTERNAL COMBUSTION ENGINE, AND ENGINE INCORPORATING SAME

CROSS-REFERENCE TO RELATED APPLICATIONS

The present invention claims priority under 35 USC 119 based on Japanese patent application No. 2008-094133, filed on Mar. 31, 2008. The entire subject matter of this priority document, including specification claims and drawings, is incorporated by reference herein.

BACKGROUND OF THE INVENTION

1. Field of the Invention

The present invention relates to a bolt fastening structure for an internal combustion engine, and to an engine incorporating same. More particularly, the present invention relates to a bolt fastening structure which is assembled by engaging an external thread formed at a tip portion of a bolt extending through a cylinder of the engine with an internal thread formed on an end face of a crankcase adjacent the cylinder.

2. Description of the Background Art

There is a known internal combustion engine in which stress is not concentrated on a fastening portion of the engine at a location to which a high load is applied by a pressure of combustion gas. An example of such internal combustion engine is disclosed in the Japanese Patent Laid-Open No. 2002-339931.

In the internal combustion engine, as disclosed in the Japanese Patent Laid-Open No. 2002-339931, a bolt fastening structure for a crankshaft rotational supporting portion for supporting a crankshaft for rotation by means of a crankcase and a main bearing cap is discussed.

In the bolt fastening structure, as disclosed the Japanese Patent Laid-Open No. 2002-339931, a cavity portion is formed continuously to an interior portion of an internal thread formed in the crankcase of the internal combustion engine.

A position of the tip of an effective thread portion of a bolt screwed in the internal thread is set between the most interior end of the internal thread portion, and a position displaced by two pitches to the base end side of the bolt from the most interior end such that the stress concentration in the vicinity of the internal thread portion is moderated by the setting of the tip position of the effective thread portion of the bolt.

However, a length of the internal thread portion from the bolt fitting end of the internal thread portion to the cavity portion, and a length from an abutting face of a head portion of the bolt with the crankcase to the tip of the effective thread portion of the bolt must be appropriately managed to minimize problems associated with stress concentration. The cited disclosure appears to have problems in managing such lengths. Therefore, there may be a fault in productivity.

The present invention has been made to overcome such drawbacks of the existing bolt fastening structure for an internal combustion engine. Accordingly, it is one of the objects of the present invention to provide a firm bolt fastening structure for an internal combustion engine.

SUMMARY OF THE INVENTION

In order to achieve the above objects, the present invention according to a first aspect thereof provides a bolt fastening structure for an internal combustion engine, wherein a cylinder cooperating with a cylinder head to form a combustion chamber, and a crankcase for rotatably supporting a crankshaft are fastened integrally by using a fastening bolt.

The bolt fastening structure for an internal combustion engine according to the first aspect of the present invention is characterized in that a bolt fitting hole is formed in the cylinder, and a cylindrical boss portion is formed on the crankcase adjacent the cylinder with respect to a crankshaft rotational support portion of the crankcase on an extension line of the bolt fitting hole. The boss portion includes an opening formed therein having internal threads which communicated with the bolt insertion hole. The opening formed in the boss portion extends through the boss portion.

Further, the bolt extends through the bolt insertion hole. The bolt includes external threads, corresponding to the internal threads of the opening of the boss portion, formed at tip end portion thereof. The bolt is engaged with the internal thread of the opening of the boss portion via the external thread thereof. A hollow recess, in which a portion of the internal thread formed in the boss portion is exposed, is formed between the boss portion and the crankshaft rotational support portion.

The present invention according a second aspect thereof, in addition to the first aspect, is characterized in that the tip portion of the external thread of the bolt is disposed in the proximity of the opening of the internal thread on the hollow recess; and that a reinforcing rib, which is positioned adjacent the hollow recess and the boss portion, and which extends in a substantially axial direction of the internal thread, is formed on the crankcase.

The present invention according a third aspect thereof, in addition to the second aspect, is characterized in that the reinforcing rib is disposed substantially parallel to axial direction of the internal threads of the boss portion.

The present invention according a fourth aspect thereof, in addition to one of the first, second and third aspects, is characterized in that an inclined face, which is cut away in an inclined relationship in a rising gradient from an inner wall face of the hollow recess toward the opening face of the hollow recess, is formed on one or both of a portion adjacent and another portion on the opposite side to the center line of the bottom face of a hollow recess formed on the inner wall of the crankcase.

EFFECTS OF THE INVENTION

According to the first aspect of the present invention, even if a bending load of the bolt screwed in the internal thread of the cylindrical boss portion formed at the cylinder side end portion of the crankcase, or a shear load acting along a transverse section of the bolt is applied to the cylindrical boss portion, the load can be released sidewardly of the bolt by the hollow recess formed on the inner wall face of the crankcase at the position just below the internal thread opening end of the cylindrical boss portion.

Therefore, the stress concentration on the inner wall portion of the crankcase, the opening end of the cylindrical boss portion and the internal thread in which the bolt external thread is screwed is minimized or may be prevented.

Further, according to the first aspect of the present invention, since the hollow recess to which the lower end of the internal thread can be opened is formed on the inner wall of the crankcase between the cylindrical boss and the crankshaft rotational support portion of the crankcase, the weight corresponding to the volume of the hollow recess is reduced.

According to the second aspect of the present invention, the crankcase on which the tip of the external thread is positioned is reinforced and stiffened by the reinforcing rib. Particularly, the strength or rigidity against a bending load concentrated upon the tip of the bolt or a shear load perpendicular to the longitudinal direction of the bolt is increased.

According to the third aspect of the present invention, the tensile load or the shear load applied to the crankcase at position where the tip of the bolt is positioned can be further moderated by the reinforcing rib extending in parallel to the opening having the internal thread formed therein.

According to the fourth aspect of the present invention, the stress concentration on one or both of corner portions from the inner wall face of the bottom face of the hollow recess to the opening face of the hollow recess on the inner wall face of the crankcase is further moderated, and the durability of the crankcase is improved.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
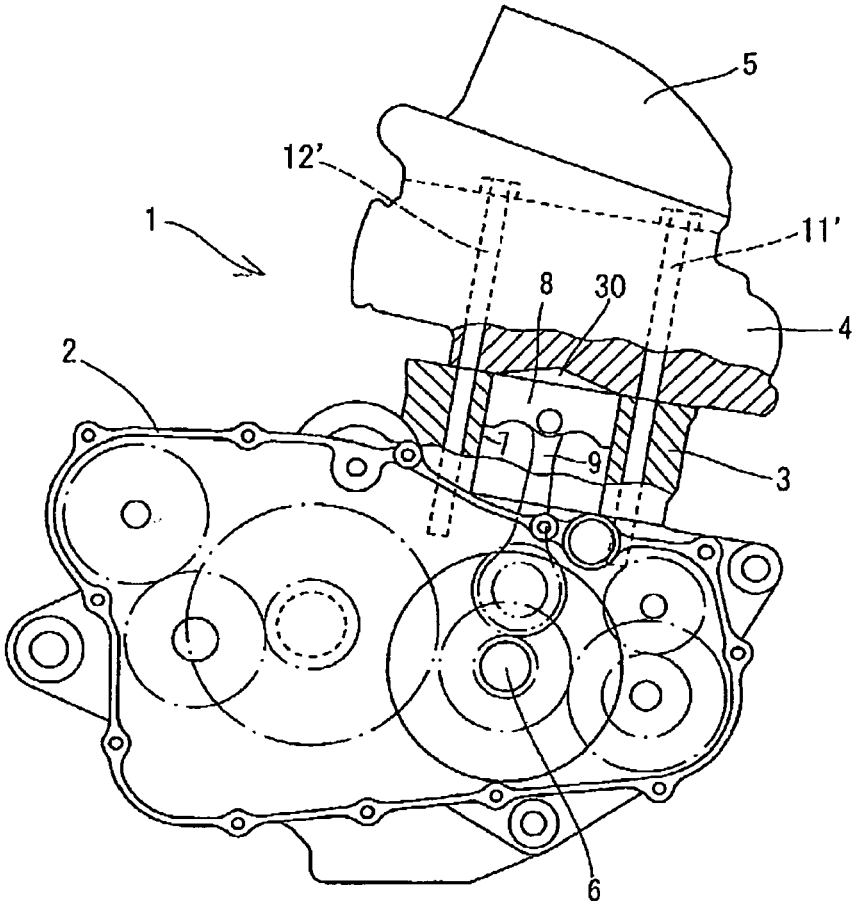
FIG. 1 is a right side view of an internal combustion engine of the present invention.

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

In the following paragraphs, illustrative embodiments of the present invention with reference to FIGS. 1 to 10 are described.

It may be noted that a top portion or an upper portion signifies the side near to a cylinder head, and a bottom portion or a lower portion signifies the side spaced from the cylinder head.

An internal combustion engine 1 to which the bolt fastening structure of the present invention is applied is a single-cylinder internal combustion engine incorporated in a motorcycle. The internal combustion engine 1 includes a pair of crankcases 2 (in the drawings, only one crankcase 2 is shown) for supporting one end side and the other end side of a crankshaft 6, a cylinder block 3 coupled with an upper portion of the crankcase 2, a cylinder head 4, and a cylinder head cover 5. The cylinder block 3 has a hollow cylinder bore formed therein. The crankshaft 6 is rotatably supported at a crankshaft rotational support portion 10 of the crankcase 2 by bearings (not shown).

A bearing side flange portion 31 is formed on the crankcase 2 and is concentric with the crankshaft rotational support portion 10. The bearing side flange portion 31 has an increased thickness on an outer periphery of the crankshaft rotational support portion 10 for reinforcing the crankshaft rotational support portion 10.

A piston 8 is fitted for upward and downward sliding movement in a cylinder bore 7 the cylinder block 3. The piston 8 and the crankshaft 6 are connected to each other by a connecting rod 9 such that, by intermittent combustion in a combustion chamber 30 defined by the cylinder block 3 and the cylinder head 4, the crankshaft 6 is driven to rotate in an interlocking relationship with reciprocating sliding movement of the piston 8.

A plurality of bolt fitting holes 11 and 12 bored substantially parallel to a center line C of the cylinder bore 7 are formed in the cylinder block 3 in a spaced relationship at a predetermined distance from the cylinder bore 7 over an outer periphery of the cylinder bore 7. The center of a cylindrical opening 13 (FIGS. 2 and 9) at a top portion of the crankcase 2, and the center of the cylinder bore 7 of the cylinder block 3 coincide with each other.

The crankcase includes openings formed therein at a top portion of the crankcase 2 along lower extension lines of the bolt fitting holes 11 and 12 of the cylinder block 3, in a state wherein a bottom face 3*a* of the cylinder block 3 is placed on a top face 2*a* of the crankcase 2 in an aligned configuration. Each of the openings has internal threads 14 and 15 formed therein.

A cylinder side flange portion 32 having an increased thickness including the top face 2*a* is formed around the cylindrical opening 13 of the crankcase 2.

Further, fastening bolts 16 and 17 extend downwardly through bolt fitting holes 11' and 12' of the cylinder head 4 and the bolt fitting holes 11 and 12 of the cylinder block 3. In order to fasten the cylinder head 4 and the cylinder block 3 to the crankcase 2, external threads 18 and 19 formed at the tip (lower end) portion of the fastening bolts 16 and 17 are engaged with (screwed into) the internal threads 14 and 15 of the crankcase 2, respectively.

Figure 2:
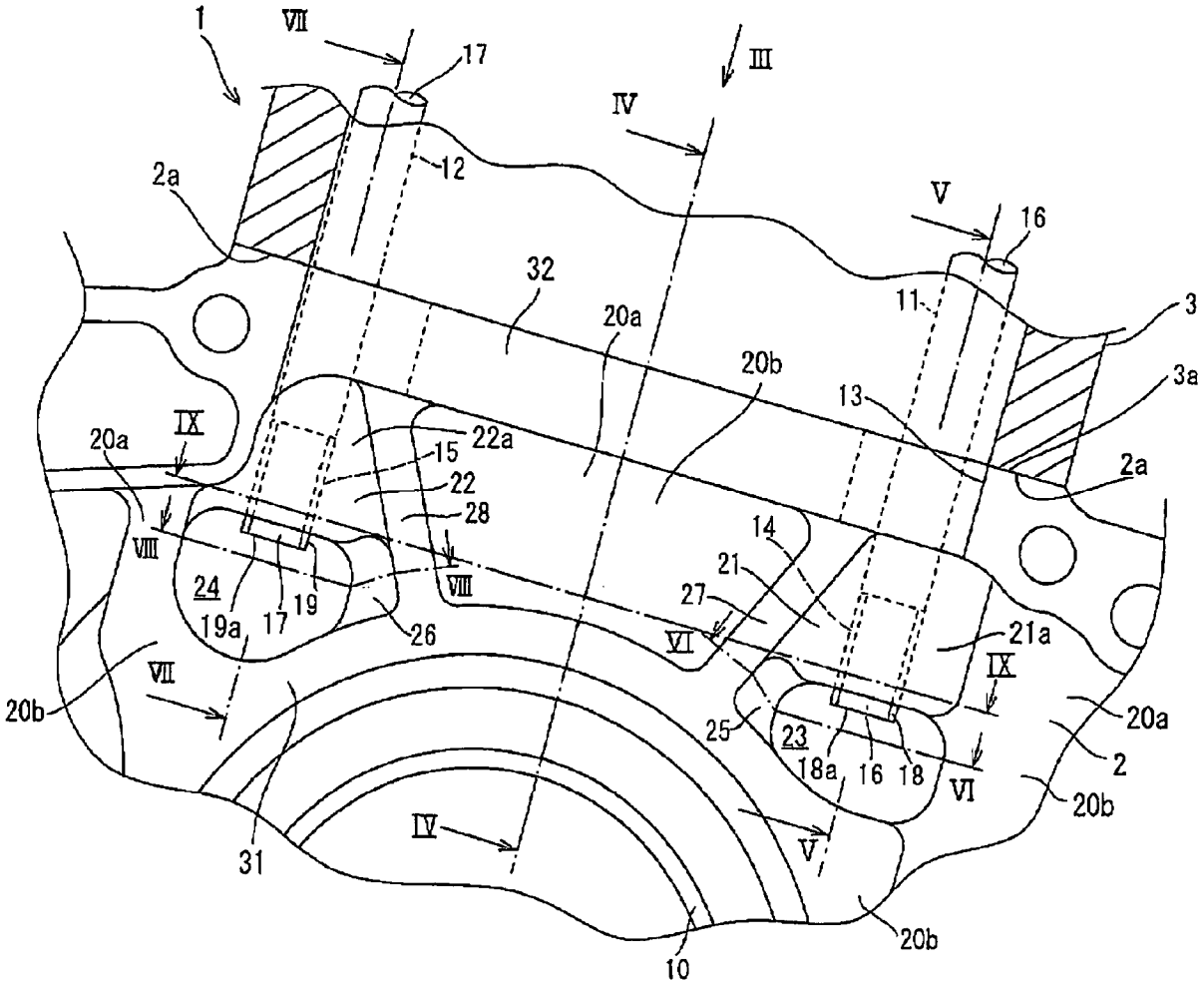
FIG. 2 is a vertical sectional side view of a mating face of a left crankcase and a cylinder of the internal combustion engine of the present invention.
Figure 3:
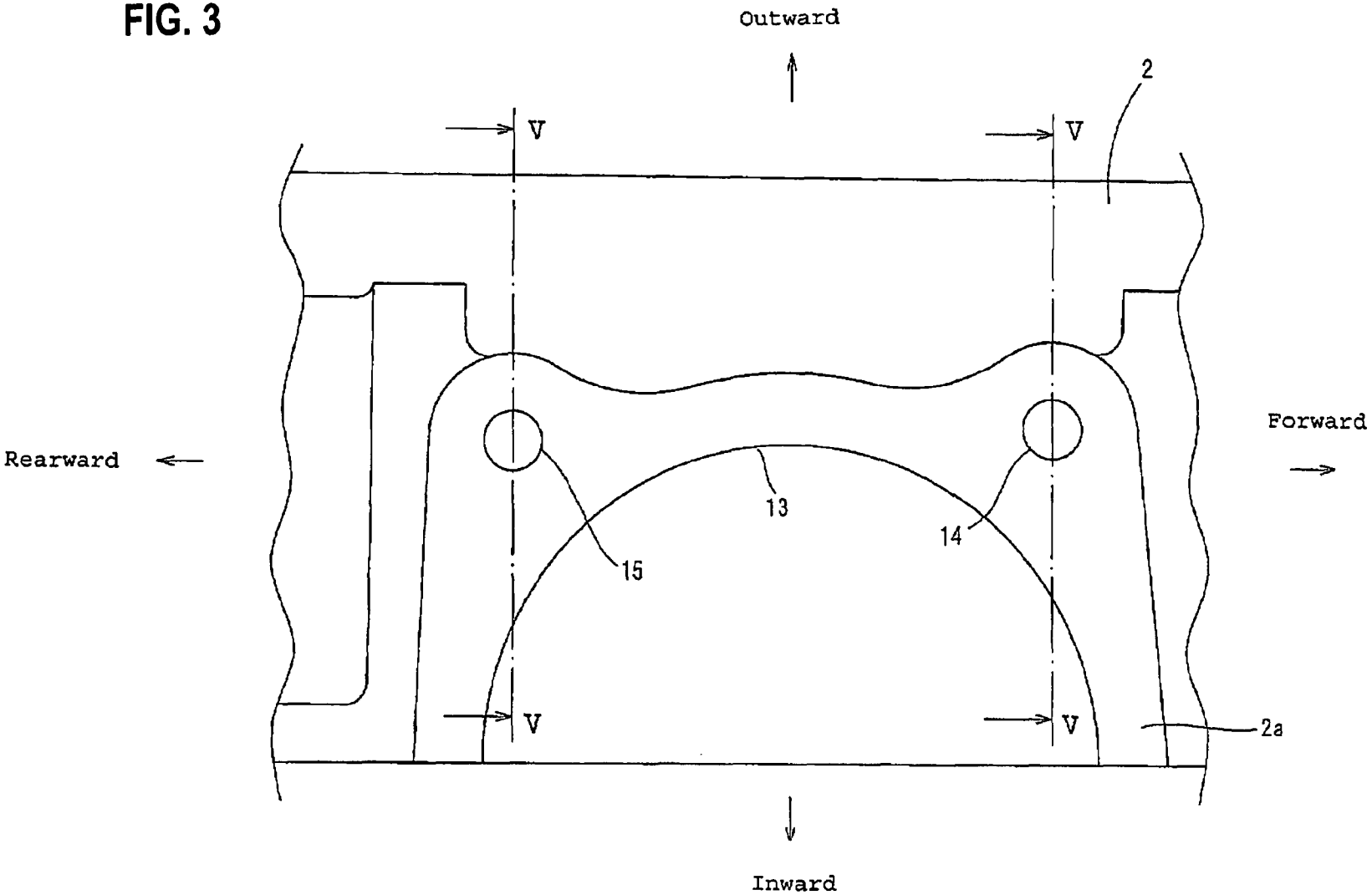
FIG. 3 is a view as viewed in the direction indicated by an arrow mark III in FIG. 2.
Figure 9:
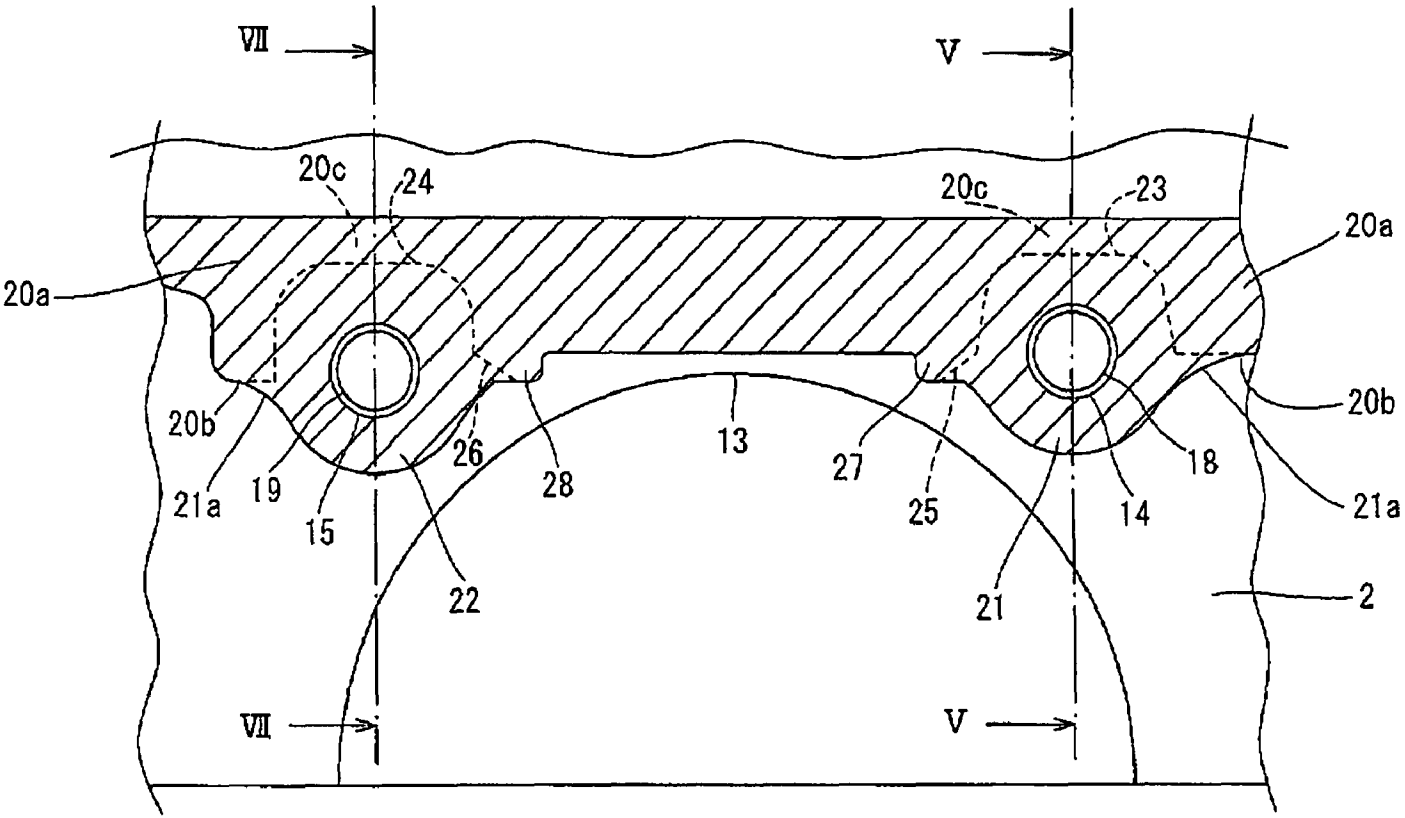
FIG. 9 is a sectional view taken along line IX-IX of FIGS. 2, 5 and 7.

As shown in FIGS. 2 and 9, a plurality of boss portions 21 and 22 formed on the crankcase have a shape extending along a portion of a cylindrical face of a larger diameter than that of the internal threads 14 and 15 in a substantially concentric relationship with the center lines of openings having the internal threads 14 and 15, respectively. The boss portions 21, 22 are positioned on an inner wall 20 below the top face 2*a* of the crankcase 2.

An outer circumferential face 21*a* of the boss portion 21 and an outer circumferential face 22*a* of the boss portion 22 are connected smoothly to an inner wall face 20*b* of an increased thickness portion 20*a* of the inner wall 20. The outer circumferential face 21*a* of the boss portion 21 and an outer circumferential face 22*a* of the boss portion 22 are positioned in a spaced relationship such that they are positioned a distance from a center extension line C of the cylinder bore 7 greater than a distance of the boss portions 21 and 22, from the center extension line C.

Respective hollow recesses 23 and 24 are formed below the corresponding boss portions 21 and 22, respectively. Further, hollow recess side openings 14*a* and 15*a* for external threads are formed on an upper face of the inner wall faces 23*a* and 24*a* of the hollow recesses 23 and 24, respectively. As seen in FIG. 2, each of openings of the respective bosses 21, 22 is in communication with an adjacent corresponding hollow recess 23, 24 at a respective junction therebetween, allowing a tip end 18*a*, 19*a* of each associated bolt 16, 17 to protrude outwardly from the opening into the respective corresponding hollow recess 23, 24.

The tip end portions (terminal ends) 18*a* and 19*a* of the external threads of the fastening bolts 16 and 17 are disposed in the proximity of the hollow recess side openings 14*a* and 15*a* of the internal threads 14 and 15 (within a range, in which the external screw threads of the fastening bolts 16 and 17 are disposed downwardly by 3 pitches from a portion upwardly by 3 pitches from the hollow recess side openings 14*a* and 15*a* of the internal threads 14 and 15).

Meanwhile, a plurality of reinforcing ribs 27 and 28 for connecting the cylinder side flange portion 32 and the bearing side flange portion 31 formed on the inner wall face 20*b* of the cylinder bore 7 are positioned closer to the center extension line C of the cylinder bore 7 than the boss portions 21 and 22 are positioned.

In particular, the reinforcing rib 27 is provided extending substantially continuously over an overall length of one side of the hollow recess 23 extending in the upward and downward direction, and an overall length of one side of the boss portion 21 extending in the axial direction of the internal thread.

Similarly, the reinforcing rib 28 is provided continuously over an overall length of one side of the hollow recess 24 extending in the upward and downward direction, and an overall length of one side of the boss portion 22 extending in the axial direction of the internal thread.

Figure 6:
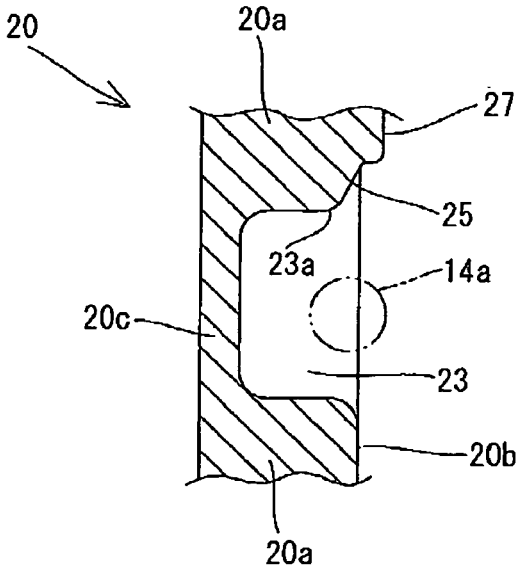
FIG. 6 is a sectional view taken along line VI-VI of FIGS. 2 and 5.
Figure 8:
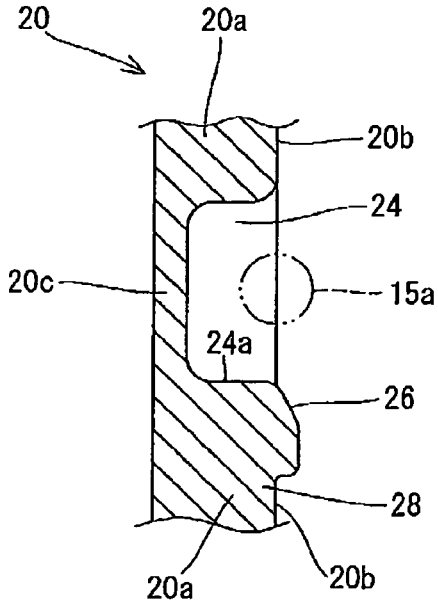
FIG. 8 is a sectional view taken along line VIII-VIII of FIGS. 2 and 7.

As shown in FIGS. 6, 8 and 9, inclined faces 25 and 26 are formed on the inner wall faces 23*a* and 24*a* of the hollow recesses 23 and 24 toward the reinforcing ribs 27 and 28, respectively.

Figure 4:
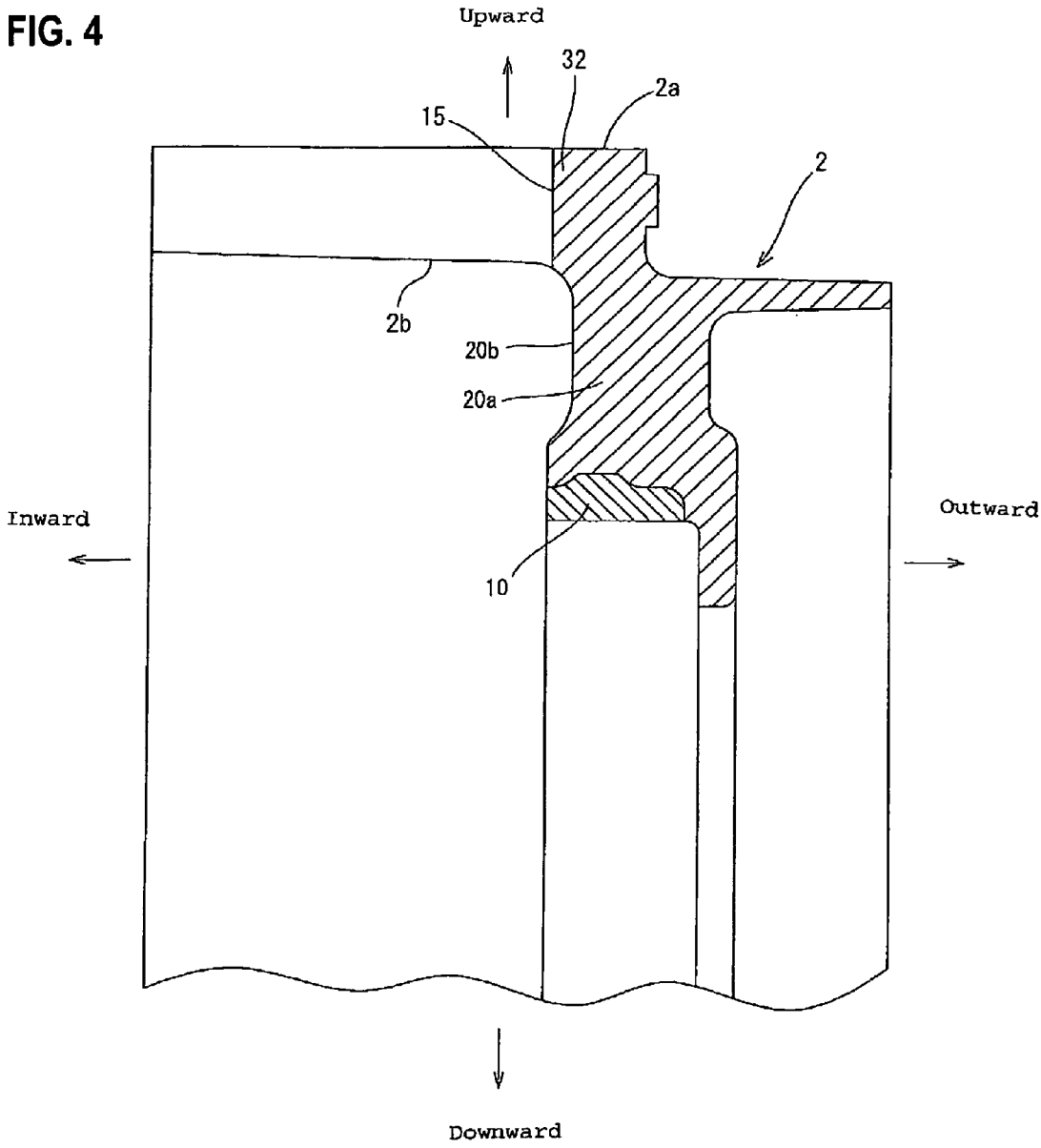
FIG. 4 is a sectional view taken along line IV-IV of FIG. 2.
Figure 7:
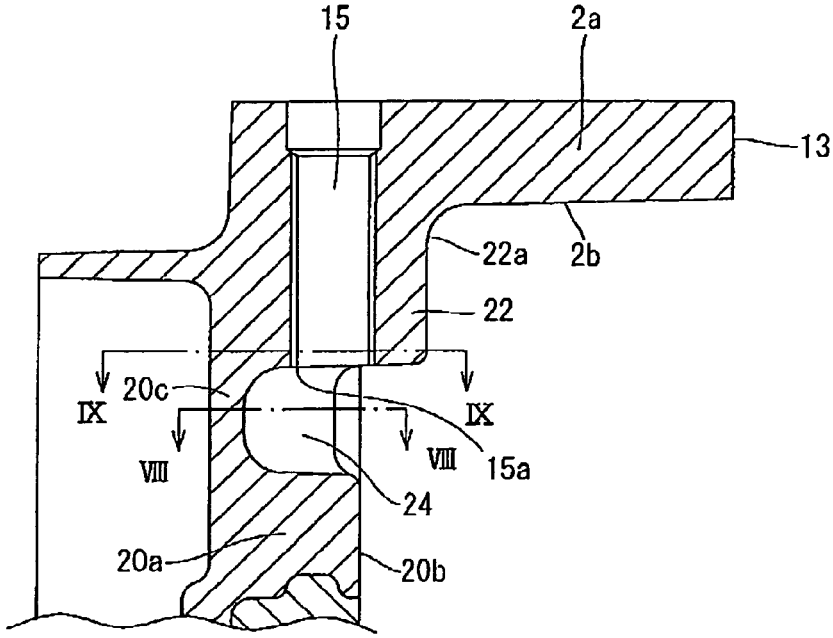
FIG. 7 is a sectional view taken along line VII-VII of FIGS. 2 and 9.

Further, as shown in FIGS. 4 and 7, outer circumferential faces 21*a* and 22*a* of the boss portions 21 and 22, and a lower face 2*b* of the crankcase top portion are connected smoothly to each other in a ¼ arc.

In the illustrative embodiment shown in FIGS. 1 to 9, since the hollow recesses 23 and 24 are formed below the boss portions 21 and 22 of the crankcase 2 in the proximity of the internal threads 14 and 15, respectively, as described hereinabove, the weight of the crankcase 2 at portions corresponding to the volume of the hollow recesses 23 and 24 is reduced.

Further, since the inner circumferential faces of the internal threads 14 and 15 of the openings formed in the crankcase 2 and outside portions of the outer circumferential faces of the boss portions 21 and 22 have substantially coaxial cylindrical shapes, as shown in FIG. 9, the thickness of a transverse sectional portion between the outer circumferential faces of the boss portions 21 and 22 and the inner circumferential faces of the internal threads 14 and 15 where a sectional view is taken along a direction perpendicular to the center lines of the internal threads 14 and 15 is substantially uniform. Accordingly the stress acting on the boss portions 21 and 22 is dispersed substantially uniformly.

Figure 5:
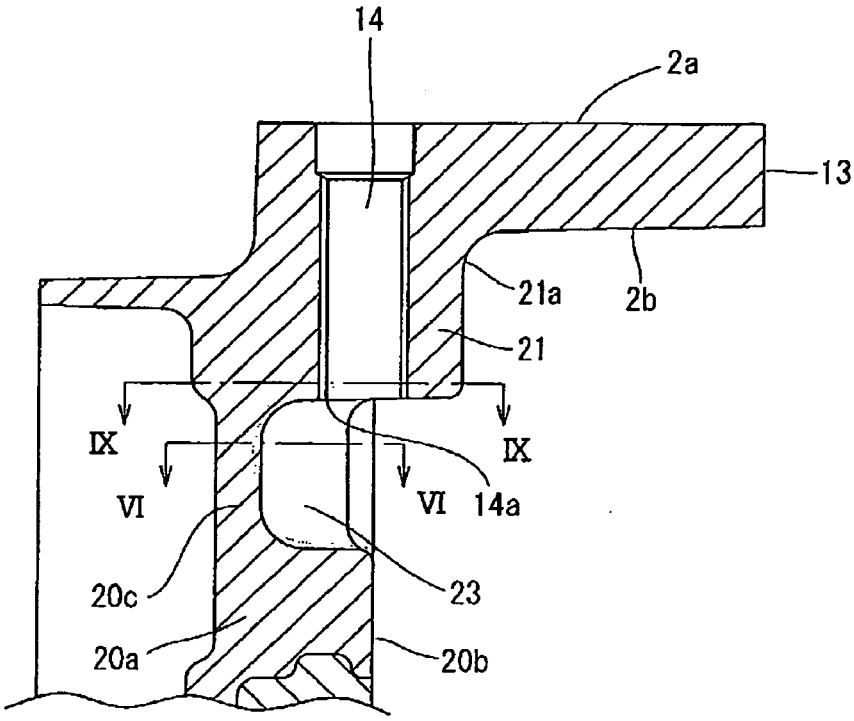
FIG. 5 is a sectional view taken along line V-V of FIGS. 2, 3 and 9.

Furthermore, even if a bending load along a plane of FIG. 5 or 7 from the fastening bolts 16 and 17 engaged with the internal threads 14 and 15 of the crankcase 2 or a shear load of the fastening bolts 16 and 17 is applied to the boss portions 21 and 22, a reduced thickness portion 20*c* of the inner wall 20 which has a reduced thickness can be deformed flexibly as shown in FIG. 6 or 8 due to the hollow recesses 23 and 24 formed on the inner wall 20 just below the boss portions 21 and 22, respectively. Accordingly, the stress concentration upon a boundary portion between the reduced thickness portion 20*c* and the increased thickness portion 20*a* can be minimized or may be prevented.

Further, since the tip portions 18*a* and 19*a* of the fastening bolts 16 and 17 are disposed in the proximity of the hollow recess side openings of the internal threads 14 and 15, although the stress by explosion in the combustion chamber 30 is concentrated on the lower end of the external threads 18 and 19 of the fastening bolts 16 and 17 engaged with the internal threads 14 and 15, respectively, the stress concentration can be moderated by the distortion of the hollow recesses 23 and 24.

Furthermore, since at a location of the increased thickness portion 20*a* of the inner wall 20 at which the boss portions 21 and 22 are positioned adjacent each other, and the reinforcing ribs 27 and 28 extending along radial directions from the central portion of the crankshaft rotational support portion 10 are provided in a swollen manner as shown in FIG. 1, the strength rigidity at the portion is increased by the reinforcing ribs 27 and 28.

In addition, since intersecting portions of the outer circumferential faces 21*a* and 22*a* of the boss portions 21 and 22 and the lower face 2*b* of the top portion of the crankcase 2 are connected to each other smoothly in a ¼ arc in cross section, even if the fastening bolts 16 and 17 are subjected to bending moment or shearing force which acts along a plane defined by the lower face 2*b* of the top portion of the crankcase 2 (FIG. 5 or 7), the bending stress or shear stress is not concentrated upon the intersecting portions between the outer circumferential faces 21*a* and 22*a* of the boss portions 21 and 22, and on the lower face 2*b* of the top portion of the crankcase 2.

Further, the internal combustion engine may be a multi-cylinder internal combustion engine only if it is of the type wherein a crankcase and cylinders are fastened to each other by fastening bolts.

Also, although the inclined face 25 on the front side is disposed rearwardly of the hollow recess 23 on the front side and the inclined face 26 on the rear side is disposed forwardly of the hollow recess 24 on the rear side, the arrangement relationship of the front and rear inclined faces 25 and 26 may be reversed. In addition, such inclined faces 25 and 26 may be provided on the opposite sides of the front and rear of the hollow recesses 23 and 24.

Furthermore, although the reinforcing rib 27 on the front side is disposed rearwardly of the hollow recess 23 and the reinforcing rib 28 on the rear side is disposed forwardly of the hollow recess 24, such arrangement of the front and rear reinforcing ribs 27 and 28 may be reversed. In addition, the reinforcing ribs 27 and 28 may be provided on the opposite sides of the front and rear of the hollow recesses 23 and 24.

Figure 10:
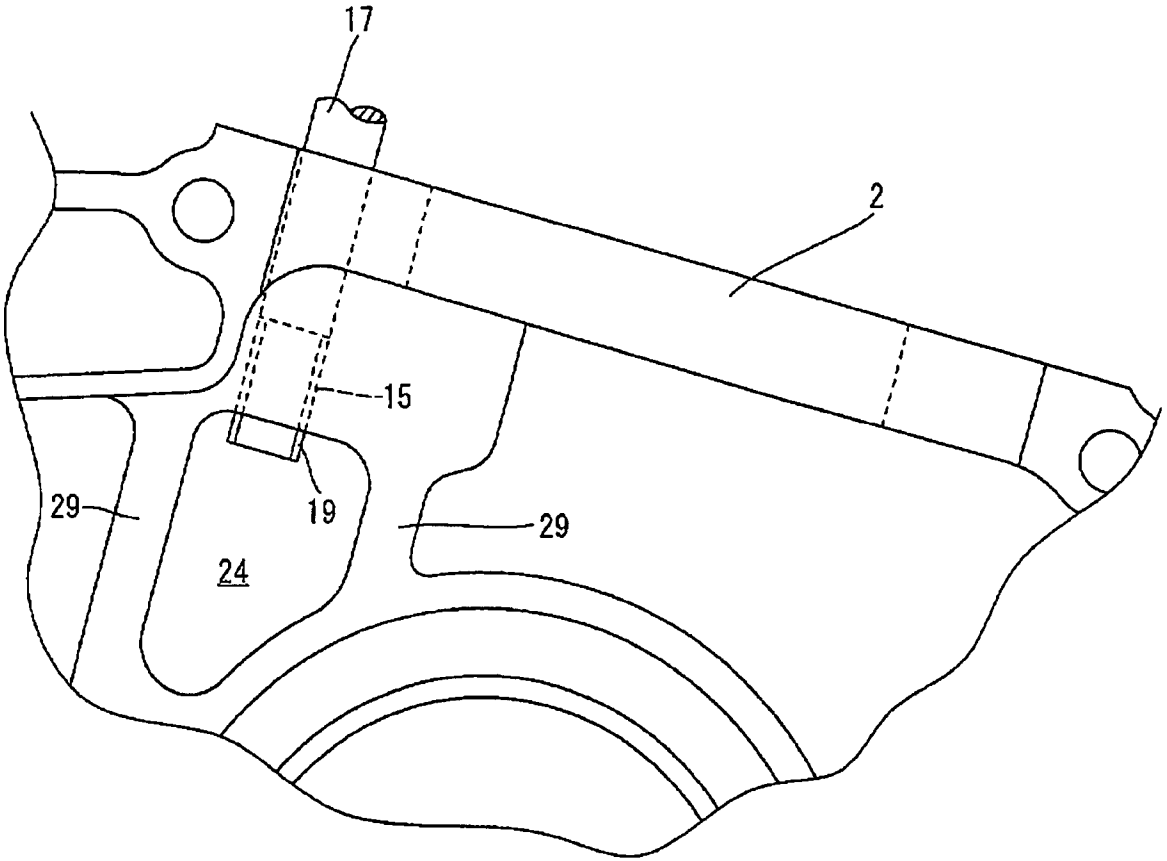
FIG. 10 is a side elevational view of another illustrative embodiment of the present invention.

Further, while in the illustrative embodiment shown in FIGS. 1 to 9, the reinforcing ribs 27 and 28 are inclined with respect to the center extension line of the cylinder bore 7 as shown in FIG. 2, reinforcing ribs 29 may be formed in parallel to each other as seen in FIG. 10.

While, in the foregoing description, the bolt is a fastening bolt, the cylinder and the crankcase may be fastened by a stud bolt.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A bolt fastening structure with an internal combustion engine, said engine comprising a cylinder block cooperating with a cylinder head to form a combustion chamber, and a crankcase for supporting a crankshaft, wherein said cylinder block, said cylinder head and said crankcase are fastened integrally together by at least one fastening bolt having an external thread formed at an end portion thereof, said bolt fastening structure comprising:

said cylinder block having a bolt fitting hole formed therein;

a substantially cylindrical boss portion formed on said crankcase on an extension line of said bolt fitting hole; said cylindrical boss portion positioned closer to said cylinder block than a crankshaft rotational support portion of said crankcase;

said boss portion having an opening formed therein and extending therethrough and having an internal thread which communicates with said bolt fitting hole;

wherein said end portion of said fastening bolt extends through said bolt fitting hole, and is engaged with said internal thread of said boss portion;

wherein said crankcase has a hollow recess formed therein between said boss portion and said crankshaft rotational support portion, said hollow recess communicating with said opening of said boss portion at a junction therebetween;

wherein an interior portion of said crankcase has a reinforcing rib formed thereon;

wherein a tip portion of said external thread of the fastening bolt extends at least to the junction of said hollow recess and said opening in said boss portion; and wherein said reinforcing rib is positioned adjacent the junction of said hollow recess and said opening in said boss portion.

2. The bolt fastening structure for the internal combustion engine according to claim 1, wherein said reinforcing rib is disposed substantially parallel to an axial direction of said internal thread of said boss portion.

3. The bolt fastening structure for the internal combustion engine according to claim 2, wherein said hollow recess includes an inclined face, cut away in an inclined relationship in a rising gradient from an inner wall face of said hollow recess toward an opening face of said hollow recess, formed on one or both of a portion adjacent and another portion on the opposite side to a center line of a bottom face of said hollow recess formed on the inner wall of said crankcase.

4. The bolt fastening structure for the internal combustion engine according to claim 1, wherein said hollow recess includes an inclined face, cut away in an inclined relationship in a rising gradient from an inner wall face of said hollow recess toward an opening face of said hollow recess, formed on one or both of a portion adjacent and another portion on the opposite side to a center line of a bottom face of said hollow recess formed on the inner wall of said crankcase.

5. The bolt fastening structure for the internal combustion engine according to claim 1, wherein said hollow recess includes an inclined face, cut away in an inclined relationship in a rising gradient from an inner wall face of said hollow recess toward an opening face of said hollow recess, formed on one or both of a portion adjacent and another portion on the opposite side to a center line of a bottom face of said hollow recess formed on the inner wall of said crankcase.

6. The bolt fastening structure for the internal combustion engine according to claim 1, further comprising said cylinder block having another bolt fitting hole formed therein; and wherein said bolt fitting holes are oriented substantially parallel to a center line of a bore of said cylinder block.

7. The bolt fastening structure for the internal combustion engine according to claim 1, wherein the reinforcing rib extends continuously over an overall length of one side of said hollow recess.

8. An internal combustion engine comprising a cylinder block having a bolt fitting hole formed therein;

a crankcase having a boss portion formed thereon adjacent said cylinder block; said boss portion having an opening formed therein as an extension of said bolt fitting hole, said opening of said boss portion having an internal thread formed therein, said crankcase further having a hollow recess formed therein between said boss portion and a crankshaft rotational support portion;

a fastening bolt having an external thread formed at an end portion thereof corresponding to said internal thread in the opening of said boss portion; said fastening bolt extending through said bolt fitting hole and engaged with said internal thread of said boss portion; and wherein said hollow recess of said crankshaft communicates with said opening of said boss portion at a junction therebetween;

wherein an interior portion of said crankcase has a reinforcing rib formed thereon;

wherein a tip portion of said external thread of the fastening bolt extends at least to the junction of said hollow recess and said opening in said boss portion; and said reinforcing rib is positioned adjacent the junction of said hollow recess and said opening in said boss portion.

9. An internal combustion engine according to claim 8, wherein said reinforcing rib is disposed substantially parallel to an axial direction of said internal thread of said boss portion.

10. An internal combustion engine according to claim 9, wherein said hollow recess includes an inclined face, cut away in an inclined relationship in a rising gradient from an inner wall face of said hollow recess toward an opening face of said hollow recess, formed on one or both of a portion adjacent and another portion on the opposite side to a center line of a bottom face of said hollow recess formed on the inner wall of said crankcase.

11. An internal combustion engine according to claim 8, wherein said hollow recess includes an inclined face, cut away in an inclined relationship in a rising gradient from an inner wall face of said hollow recess toward an opening face of said hollow recess, formed on one or both of a portion adjacent and another portion on the opposite side to a center line of a bottom face of said hollow recess formed on the inner wall of said crankcase.

12. An internal combustion engine according to claim 8, wherein said hollow recess includes an inclined face, cut away in an inclined relationship in a rising gradient from an inner wall face of said hollow recess toward an opening face of said hollow recess, formed on one or both of a portion adjacent and another portion on the opposite side to a center line of a bottom face of said hollow recess formed on the inner wall of said crankcase.

13. An internal combustion engine according to claim 8, wherein said cylinder block has another bolt fitting hole formed therein, and wherein said bolt fitting holes are directed substantially parallel to a center line of a bore formed in said cylinder block.

14. An internal combustion engine according to claim 8, wherein the reinforcing rib extends continuously over an overall length of one side of said hollow recess.

15. An internal combustion engine having a bolt fastening structure formed therein, said internal combustion engine comprising:

a cylinder block having a plurality of bolt fitting holes formed therein;

a crankcase having a plurality of boss portions formed thereon adjacent said respective bolt fitting holes of said cylinder block; each of said boss portions having an opening formed therein as an extension of a corresponding one of said bolt fitting holes; said opening having an internal thread formed therein;

a plurality of fastening bolts, each having an external thread formed at an end portion thereof for engagement with said internal thread of a corresponding opening; said fastening bolts extending through said bolt fitting holes and engaged with internal threads of corresponding boss portions;

wherein each of said hollow recesses communicates with a corresponding opening of an adjacent one of said boss portions at a respective junction therebetween;

wherein an interior portion of said crankcase has a reinforcing rib formed thereon;

wherein a tip portion of said external thread of each of the fastening bolts is disposed in a vicinity of the corresponding opening of said internal thread on said hollow recess; and wherein said reinforcing rib is positioned adjacent said hollow recess and said boss portion, and extends in an axial direction of said internal thread formed on boss portion.

16. An internal combustion engine according to claim 15, wherein said reinforcing ribs are disposed substantially parallel to said internal thread of said boss portion.

17. An internal combustion engine according to claim 15, wherein an inclined face, cut away in an inclined relationship in a rising gradient from an inner wall face of each of said hollow recesses toward the opening face thereof, is formed on at least one of a portion adjacent to and another portion on an opposite side to a center line of the bottom face of another hollow recess formed on an inner wall of said crankcase.

* * * * *